US007047731B2

(12) United States Patent
Foster et al.

(10) Patent No.: US 7,047,731 B2
(45) Date of Patent: May 23, 2006

(54) DIESEL PARTICULATE FILTER ASH REMOVAL

(75) Inventors: Michael Ralph Foster, Columbiaville, MI (US); Robert D. Wendling, Chesaning, MI (US); Jarrod C. Sherwood, Vassar, MI (US); Egas Jose Desousa, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 269 days.

(21) Appl. No.: 10/170,889

(22) Filed: Jun. 12, 2002

(65) Prior Publication Data

US 2003/0159436 A1 Aug. 28, 2003

Related U.S. Application Data

(60) Provisional application No. 60/359,971, filed on Feb. 27, 2002, provisional application No. 60/363,776, filed on Mar. 13, 2002.

(51) Int. Cl.
*F01N 3/00* (2006.01)

(52) U.S. Cl. ..... 60/297; 60/274; 60/311

(58) Field of Classification Search ..... 60/274, 60/311, 297, 295; 55/DIG. 30
See application file for complete search history.

(56) References Cited

U.S. PATENT DOCUMENTS 3,696,619 A * 10/1972 Rosa ..... 60/297
3,712,029 A * 1/1973 Charlton ..... 96/3
3,738,089 A * 6/1973 Brill ..... 55/310
3,824,769 A * 7/1974 Santos et al. ..... 96/275
4,373,330 A * 2/1983 Stark ..... 60/311
4,419,108 A * 12/1983 Frost et al. ..... 60/311
4,419,113 A * 12/1983 Smith ..... 55/484
4,466,816 A * 8/1984 Felker ..... 55/315.1
4,503,672 A * 3/1985 Stark et al. ..... 60/286
4,531,363 A * 7/1985 Ludecke et al. ..... 60/303
4,535,588 A * 8/1985 Sato et al. ..... 60/286
4,571,938 A * 2/1986 Sakurai ..... 60/311
4,573,317 A * 3/1986 Ludecke ..... 60/303
4,864,821 A * 9/1989 Hoch ..... 60/274
5,063,736 A * 11/1991 Hough et al. ..... 60/311
5,272,874 A * 12/1993 Paas ..... 60/297
5,388,400 A * 2/1995 Hoppenstedt et al. ..... 60/274
5,397,550 A * 3/1995 Marino, Jr. ..... 422/178
5,566,545 A * 10/1996 Hijikata et al. ..... 60/274

(Continued)

FOREIGN PATENT DOCUMENTS

DE 4313132 * 10/1994

*Primary Examiner*—Thomas Denion
*Assistant Examiner*—Diem Tran
(74) *Attorney, Agent, or Firm*—Paul L. Marshall

(57) ABSTRACT

Disclosed herein is a method for reducing internal combustion engine contaminate and additive particulate matter from a particulate filter the method including accessing the filter and entraining particulate matter in a fluid stream. Further disclosed herein is an internal combustion engine particulate filter system including a canister, a filter media mounted in said canister and an access opening in said canister. Yet still further disclosed herein is a method for determining condition of a particulate filter in situ including establishing a vacuum value for a clean particulate filter in situ, establishing a vacuum value for a used particulate filter in situ; and comparing the established value for the clean filter versus the used filter.

6 Claims, 9 Drawing Sheets

U.S. PATENT DOCUMENTS 6,230,494 B1 5/2001 Botti et al.
6,423,896 B1 7/2002 Keegan
6,485,852 B1 11/2002 Miller et al.
6,500,574 B1 12/2002 Keegan
6,509,113 B1 1/2003 Keegan
6,551,734 B1 4/2003 Simpkins et al.
6,562,496 B1 5/2003 Faville et al.
6,608,463 B1 8/2003 Kelly et al.
6,609,582 B1 8/2003 Botti et al.
6,613,468 B1 9/2003 Simpkins et al.
6,613,469 B1 9/2003 Keegan
6,620,535 B1 9/2003 Mukerjee et al.

* cited by examiner

DIESEL PARTICULATE FILTER ASH REMOVAL

CROSS REFERENCE TO RELATED APPLICATIONS

The present application is a U.S. non-provisional application based upon and claiming priority of U.S. provisional application Ser. Nos. 60/359,971 filed Feb. 27, 2002 and 60/363,776 filed Mar. 13, 2002, which are hereby incorporated by reference.

BACKGROUND

Particulate filters are employed in internal combustion engine exhaust systems where particulate escape to the environment is not desirable. One such system is that of a diesel exhaust system. In such system, a combustion source produces some particulate matter and that matter is filtered out of the exhaust gas stream from that combustion source before exhaust gas therefrom is released to atmosphere or another system. The hydrocarbon particulate is periodically removed by means of a high temperature regeneration process that is controlled by the vehicle engine computer, and that occurs when needed, automatically while the vehicle is in use. In addition to the hydrocarbon particulate matter other contaminants, such as zinc dithiophosphate, from the engine lubricating oil, and cerium, which is sometimes added to the fuel to aid regeneration, is trapped in the filter system. Since the automatic regeneration process does not remove these materials, they gradually plug the pores in the filter. Such particulate filter systems lose efficiency with usage due to contaminate, and additive particulate matter buildup. Arrangements and methods associated with the reduction of costs and time involved in cleaning and/or replacement of such particulate filters is desirable.

SUMMARY

Disclosed herein is a method for reducing contaminate, and additive particulate matter in a diesel particulate filter, including accessing the filter and entraining contaminate, and additive particulate matter in a fluid stream.

Further disclosed herein is a diesel particulate filter system including a canister, a filter media mounted in said canister and an access opening in said canister.

Yet further disclosed herein is a low cost particulate filter system having access for particulate removal, the system including a canister, a filter mounted in the canister, a flange retainer without a seal and a sleeve disposed in said canister and configured to inhibit particulate leakage from and flange retainer.

Still further disclosed herein is a low cost particulate filter system having access for contaminate, and additive particulate removal including a canister, a sub canister positionable in said canister, a filter mounted in said sub canister and a single flange retainer closing said canister and mounting said sub canister.

Yet still further disclosed herein is a method for determining condition of a particulate filter in situ including establishing a vacuum value for a clean particulate filter in situ, establishing a vacuum value for a used particulate filter in situ; and comparing the established value for the clean filter versus the used filter.

BRIEF DESCRIPTION OF THE DRAWINGS

The present invention will now be described, by way of an example, with references to the accompanying drawings, wherein like elements are numbered alike in the several figures in which.

DETAILED DESCRIPTION

Figure 1:
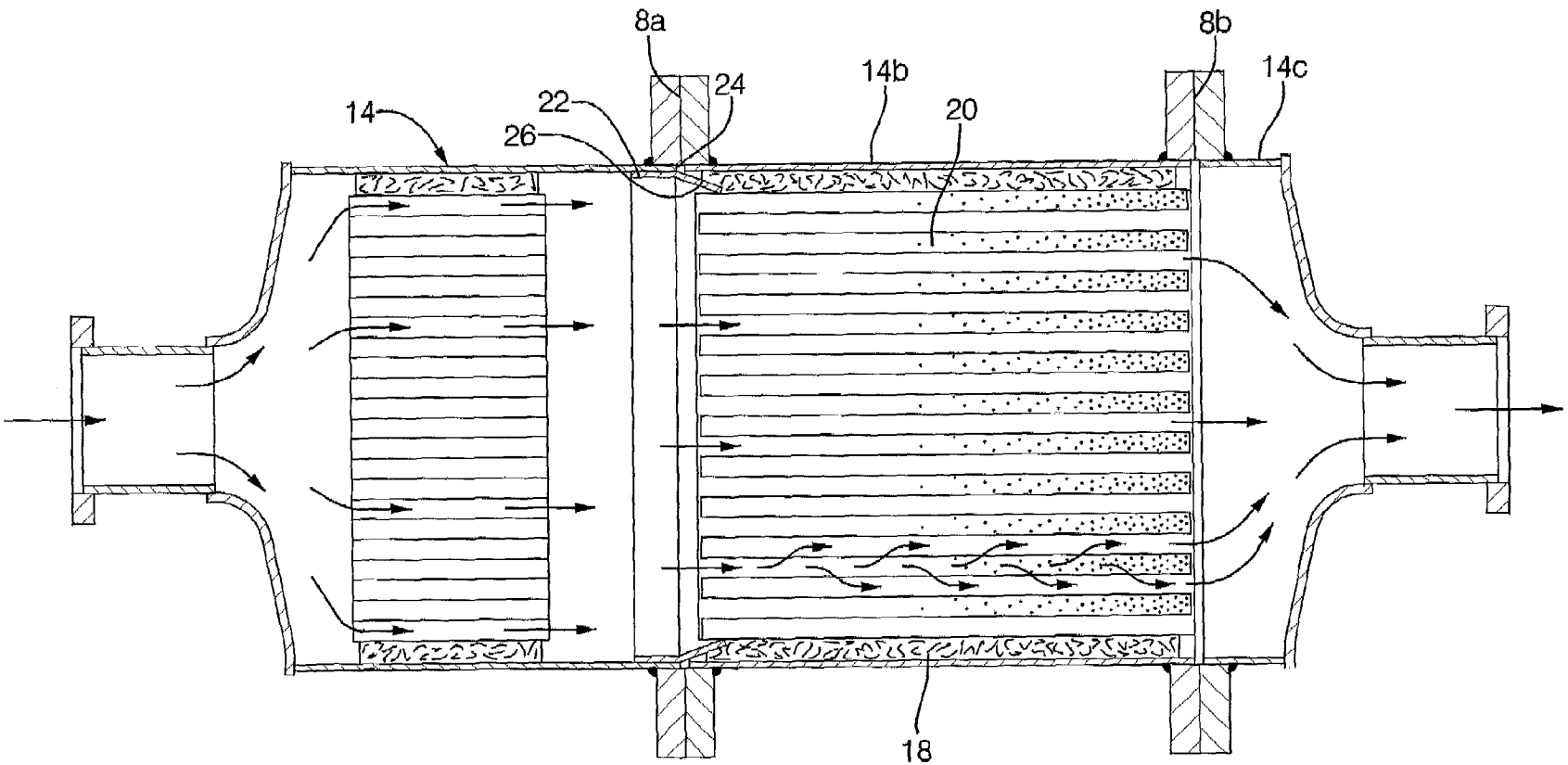
FIG. 1 is a schematic cross-sectional view of a canister supporting a catalyst substrate and a particulate filter.

It is to be appreciated that although several of the drawing figures herein include a catalyst substrate, this is for contextual purposes and for one embodiment of the invention as disclosed herein. It is not germane to that which is claimed whether or not the catalyst substrate is illustrated or included in the canister in which the filter is supported. If the drawings were modified to omit the catalyst, the function and construction of that disclosed herein will remain unchanged. Notwithstanding the foregoing, some of the drawings do include the catalyst substrate as one embodiment of the invention as it is employed with a diesel catalytic converter and particulate filter system.

Further, it is noted that a catalyst substrate can in some conditions trap particulate matter and in such condition be, in effect, a filter. For this reason, it is to be understood that the device and method described herein can be used to remove particulate matter from a catalyst in the same way as described for a filter hereafter.

Referring to FIG. 1, one of skill in the art will recognize a construction similar to the existing art, having a canister 14 in three sections a, b and c affixable together by two sets of paired flanges 8*a*, 8*b*. One will also recognize an intumescent or non-intumescent support material 18 supporting a particulate filter 20. Distinct from the existing art however is that at flanges 8*a*, 8*b* no seals are evident. Seals are expensive and in this embodiment are avoided. Tubular sleeve 22 is affixed in a sealed manner to canister section 14*a* and extends beyond an end 24 thereof. The extended region 26 of sleeve 22 is configured to engage material 18 and may be of frustoconical shape to make such engagement centrally of material 18. The configuration is meant to and is effective in preventing particulate matter from migrating to flanges 8*a* thus preventing leakage therefrom regardless of the absence of a seal at flange 8*a*. A seal is not necessary at 8*b* because the particulate has already been filtered out of the stream passing through canister 14 by the time that stream contacts flanges 8*b*. If a seal is desired at the exit end of the particulate filter, a similar tubular sleeve can be used to seal the exit flange.

In an alternate embodiment, one of the flange pairs 8 is completely eliminated. Additionally, and as a consequence of elimination of one of the flange pairs, canister section 14*b* has also been eliminated. Canister section 14*a* and 14*c* remain, in slightly distinct dimensions from the previous embodiment. In this embodiment, (FIG. 2) a sub canister 28 is employed to support particulate filter 20 and material 18. Sub canister 28 is made stable within canister 14 by the provision of a flange 30 which may be fully or partly annular. The flange may be constructed by compressing the ends of a tubular structure or by any other means including welding an annular flange onto the O.D. of the tubular structure. Flange 30 is received and captured in flange 8 during manufacture or reassembly and maintained in position thereby. To effect this condition it will be recognized that flanges 8 include a keyway 32 formed about ½ in each flange side. The flanges 8 include a seal 34 that may be of the metal o-ring type and are fastened together by any number of means including separate fasteners such as bolts. Each of the flanges 8 are affixed to the canister sections 14*a*/14*c* by welding, illustrated at beads 36. This construction facilitates accessing filter 20, repositioning of the same and cleaning of the same.

Figure 2:
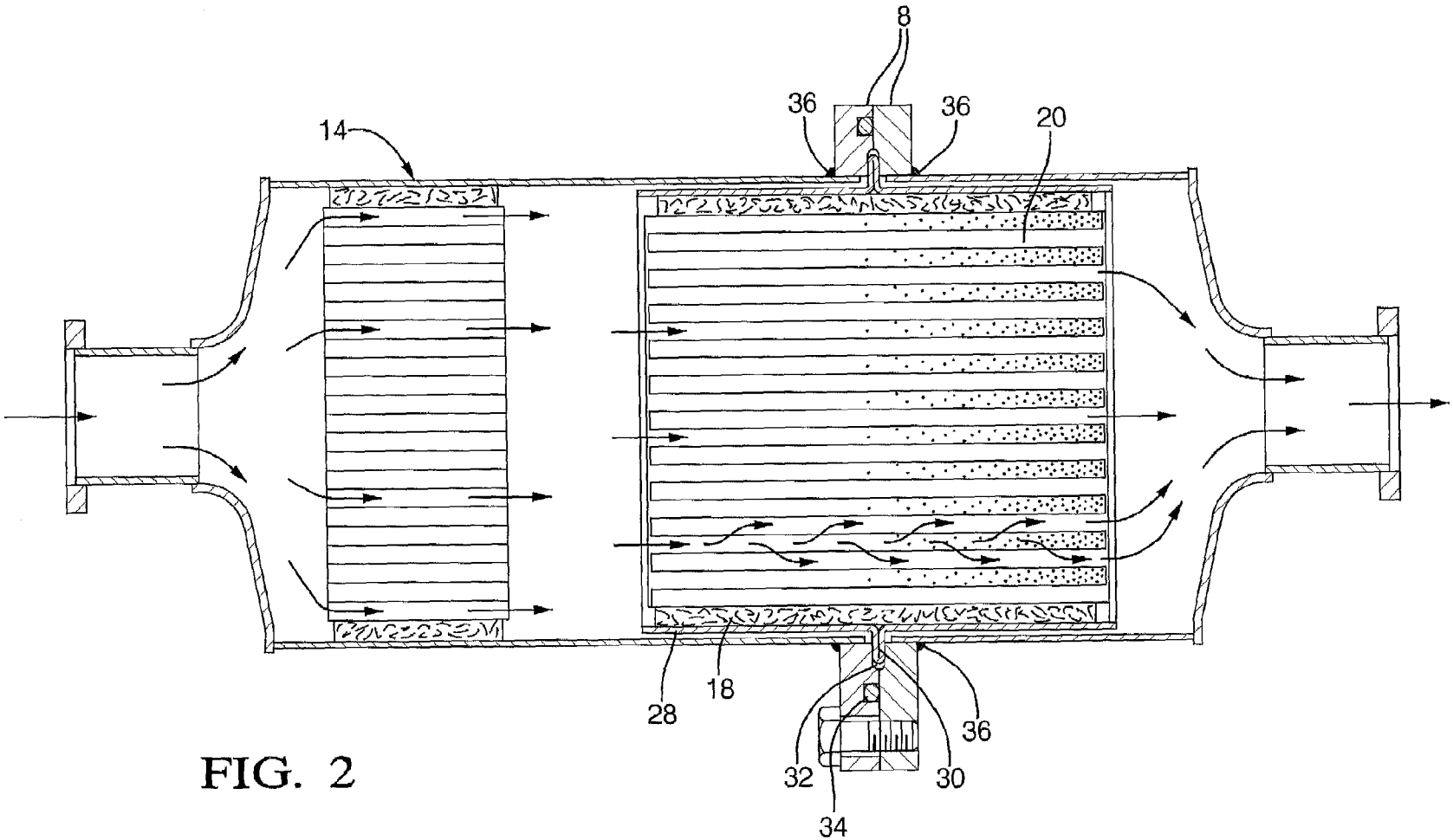
FIG. 2 is a schematic cross-sectional view of an alternate canister supporting a catalyst substrate and a particulate filter.
Figure 3:
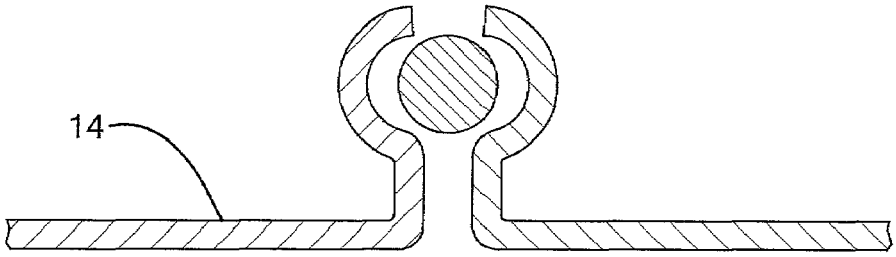
FIG. 3 is a schematic cross-sectional view of an o-ring seal arrangement.
Figure 4:
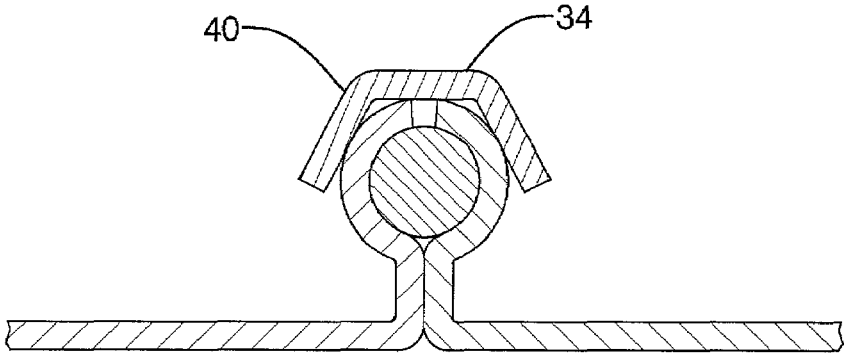
FIG. 4 is the illustration of FIG. 3 with a v-clamp securing the components thereof.
Figure 4A:
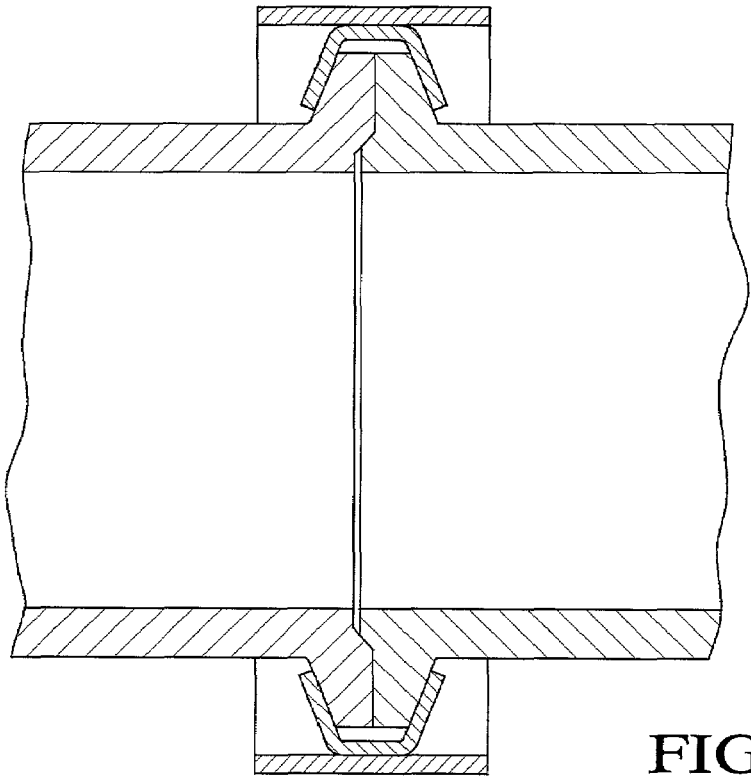
FIG. 4A is a view of a commercially available v-clamp.

Referring to FIGS. 3 and 4 and back to FIGS. 1 and 2, an alternate seal construction for canister 14 is illustrated. In the embodiment of FIGS. 3 and 4, canister 14 is configured to accept an o-ring. The canister sections are then secured with a commercially available "V-clamp" 40. FIG. 4*a* is a view of the commercially available V-clamp.

Figure 5:
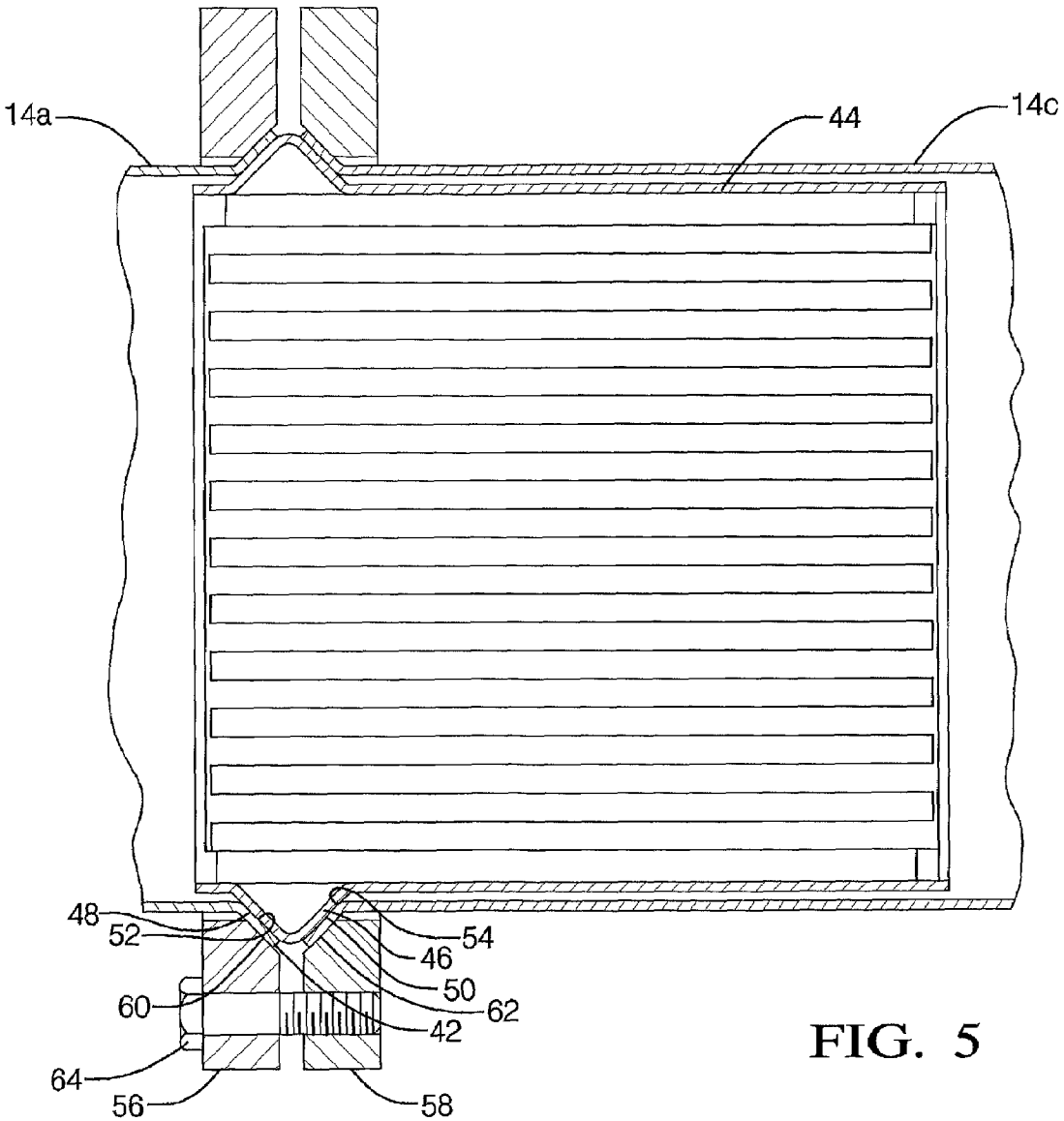
FIG. 5 is a schematic partial cross-sectional view of an alternate particulate filter support arrangement.

In yet another embodiment, referring to FIG. 5, an o-ring seal is avoided by the provision of a metal-to-metal seal structure. Canister section 14*a* and canister section 14*c* each include a flared meeting edge 42. The flare is about 45 degrees in an outwardly direction. A sub canister 44, similar to the sub canister discussed above, includes a distinct annular or part annular flange 46. The flange 46 extends outwardly from the sub canister 44 at about a 45 degree angle such that two angled faces 48, 50 are created. It is these faces 48, 50 when pressed against inside surfaces 52, 54 of meeting edges 42 that creates the metal-to-metal seal. In order to effect the seal a flange pair 56, 58, having an angled surface 60, 62, each of which is complementary to meeting edges 42, is fastened together with fasteners such as bolts 64 to compressively join the above discussed components.

Each of the foregoing embodiments allows access to the filter 20 for removal, repositioning, cleaning, replacement, etc. These are desirable attributes and are less expensive than prior art configurations but do still require relatively costly hardware.

Figure 6:
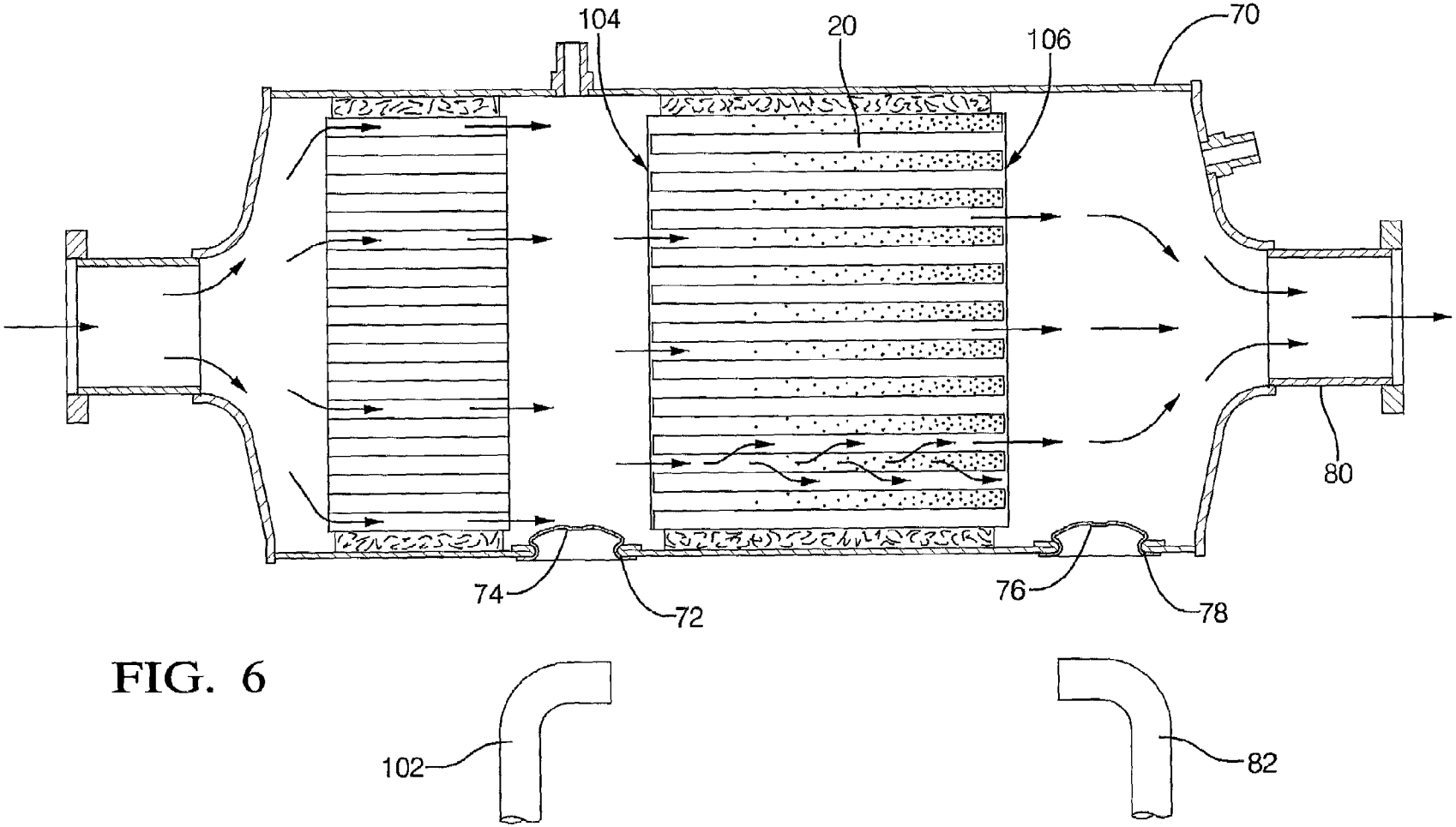
FIG. 6 is a schematic cross-sectional view of an alternate canister with access openings and plugs.

Alternately, referring to FIG. 6, a canister 70 is configurable to facilitate cleaning of filter 20. As illustrated the filter is mounted conventionally. FIG. 6 includes openings related to cleaning of the filter.

Figure 9:
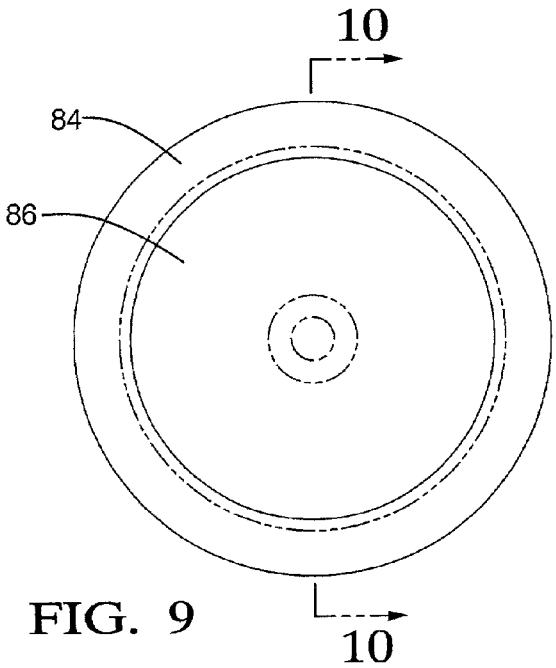
FIG. 9 is a plan view of a commercially available plug.
Figure 10:
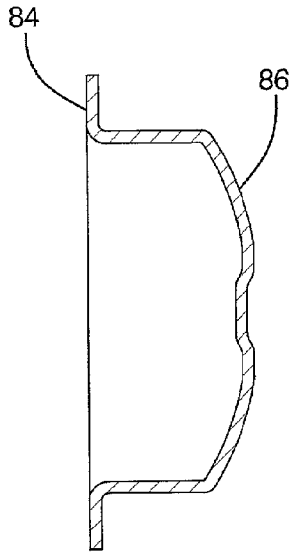
FIG. 10 is a cross-sectional view of a commercially available plug.
Figure 11:
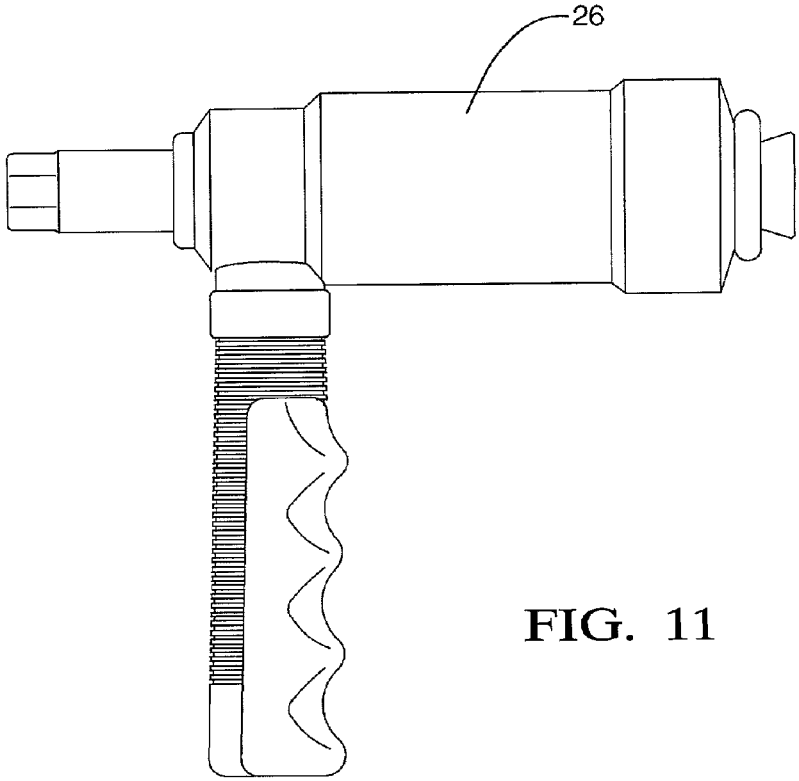
FIG. 11 is a view of a commercially available tool to install the plug of FIGS. 9 and 10.
Figure 12:
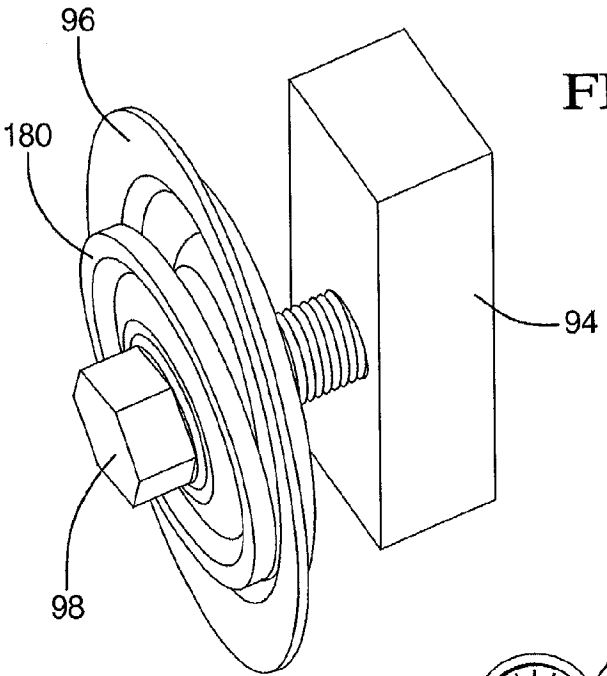
FIG. 12 is an alternate common available plug.

Opening 72 is closeable by a plug which may be of a number of different types. One type of plug employable is a sheet metal fill plug 74 (detail views are available in FIGS. 9 and 10). These are reliable plugs while remaining easily removable. The structure of plug 74 is, referring to FIGS. 9 and 10, a single piece of sheet metal which has been stamped to create a top hat type appearance with brim 84 and crown 86. Crown 86 comprises a domed top 88 and an annular connector 90 extending between top 88 and brim 84. In use, a tool 92 illustrated in FIG. 11 is employed to expand annular connector 90 while plug 74 or 76 is installed in opening 72, 78 respectively, which permanently locks the plug in place. The plug may then only forcibly and destructively be removed. The tool is commercially available and is known to the art as a "plug expander tool". Referring to FIG. 12, an alternate plug is illustrated which comprises a bar 94 which may be square in cross-section, with a threaded hole in the center as illustrated, and which is to be positioned inside opening 72, 78 and a cover 96 intended to cover opening 72, 78. A bolt 98 and washer 100 are employed as shown to urge cover 96 against canister 70 for a tight seal. This plug is removable without destruction thereof. With a plug 74 removed, opening 72 is large enough to allow insertion of a negative pressure conduit. Negative pressure may be created by any means.

Figure 7:
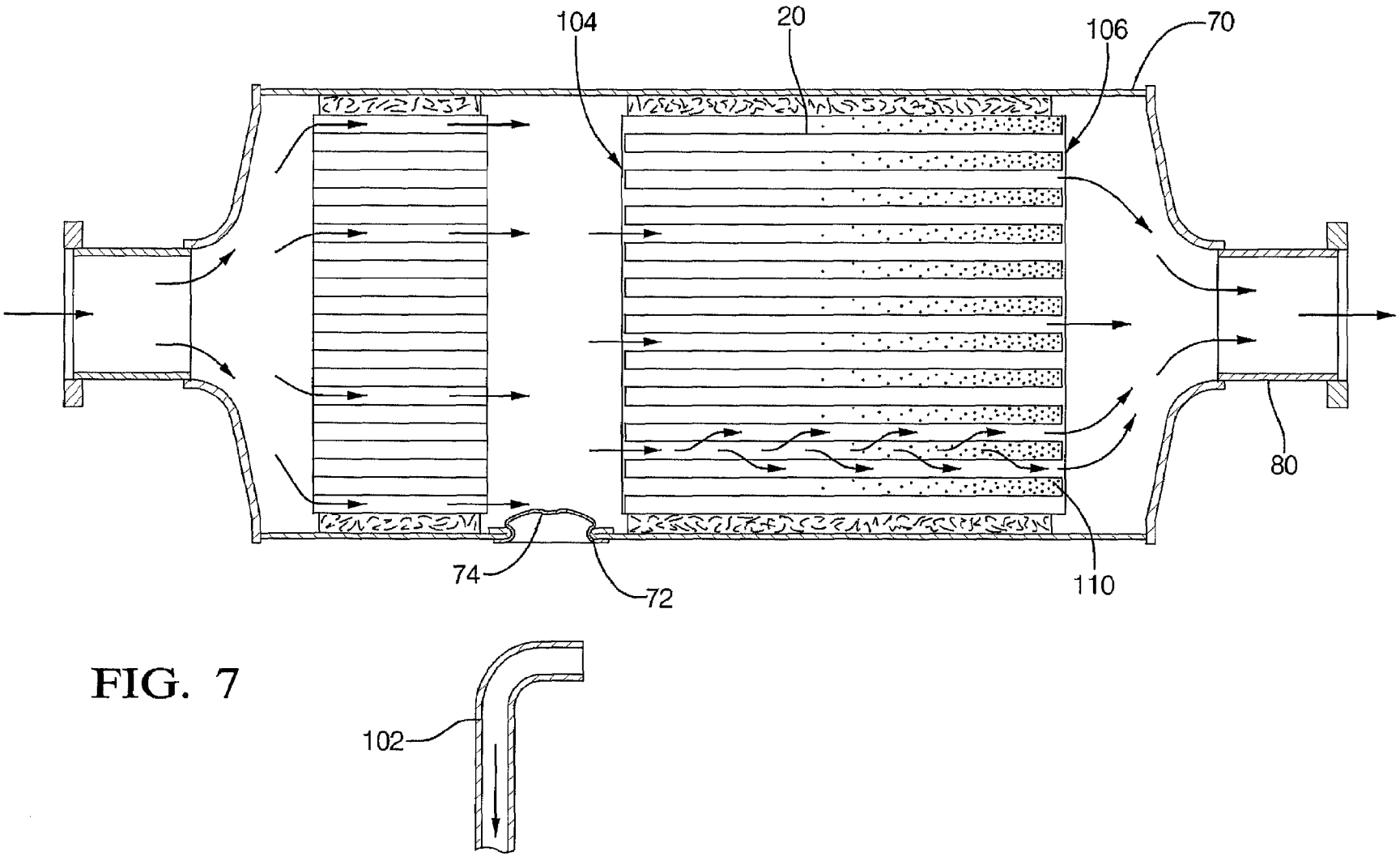
FIG. 7 is a view similar to FIG. 6 intended to illustrate the "normal operation" flow of fluid through the system and particulate buildup.

In one embodiment (FIGS. 7 and 8) plug 74 is removed solely and fluid flow whether the fluid be gas or liquid such as air, water, solvent, etc. through filter 20 is induced simply by drawing fluid through conduit 80. Where more direct positive pressure fluid, again whether that fluid be gas or liquid such as air, water, solvent, etc., is desired, plug 76 is removed from opening 78, downstream of filter 20. Positive pressure from any source may then be introduced either generally through opening 78 or by insertion of a positive pressure conduit 82 to direct the positive pressure flow to discrete areas of the filter 20.

Referring back to FIG. 6, several embodiments are considered. The first is the provision of a negative pressure through a negative pressure conduit 102 to the normally upstream end 104 of filter 20. Fluid flow in this embodiment is caused solely by the negative pressure at upstream end 104 or by negative pressure at 104 in addition to a positive pressure applied through conduit 80 from a "normal operation" exhaust exit (not shown). This embodiment is further illustrated in FIGS. 7 and 8 in clear detail where particulate matter 110 is illustrated collecting in filter 20 during normal operation of the combustion source and the exhaust system.

Figure 8:
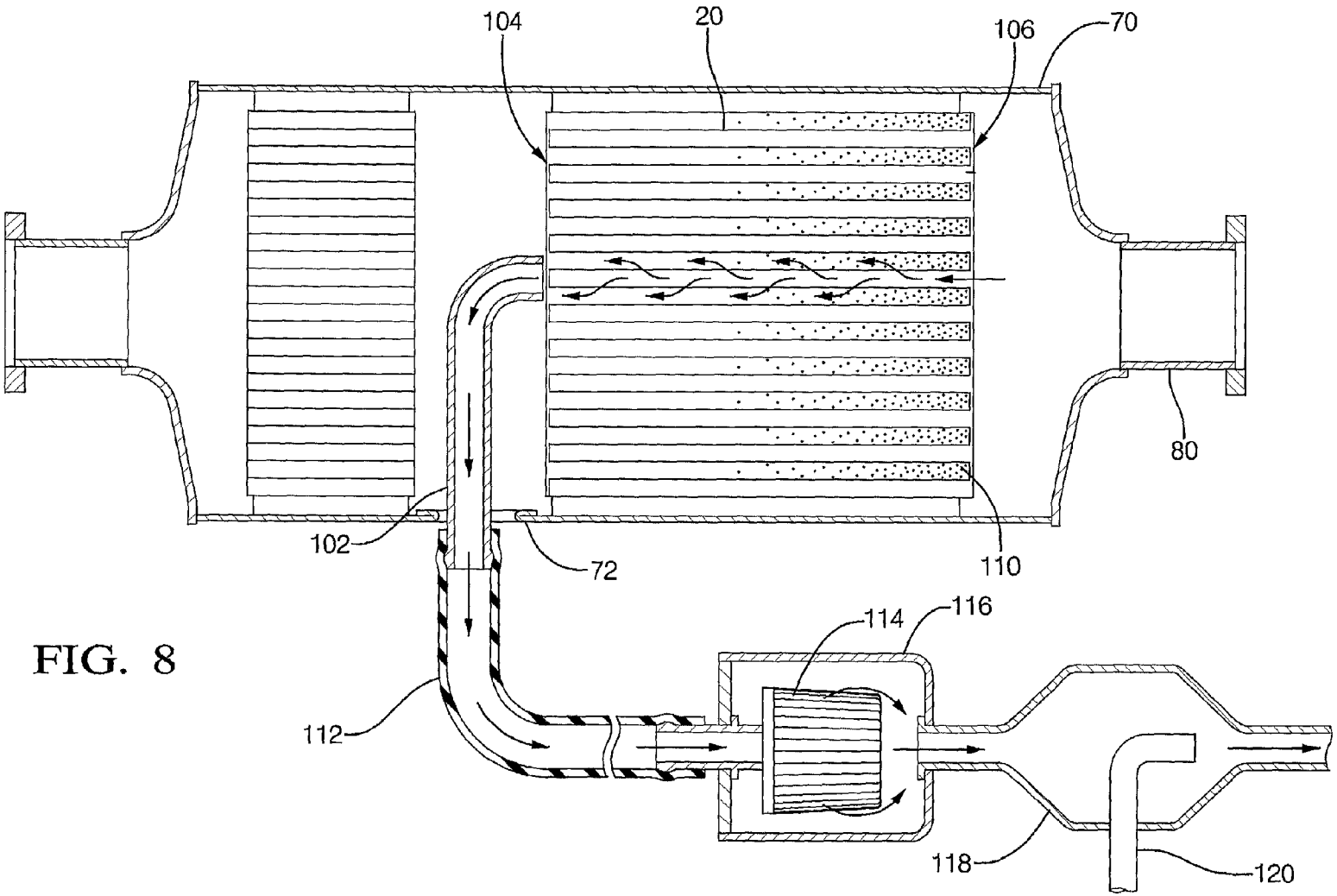
FIG. 8 is the FIG. 7 view with a plug removal and a negative pressure conduit extended into the canister.

With negative pressure conduit 102 inserted into conduit 70 (FIG. 8) through opening 72 and located in a discrete area of upstream end 104 of filter 20, particulate matter, contaminant and additive material 110 is illustrated being removed from filter 20. FIG. 8 further illustrates one negative pressure supply arrangement which is fully understandable by one of skill in the art simply by viewing the drawing. A hose 112 is connected to a filter 114 in a housing 116 which is then connected to a venturi 118 creating vacuum by shop air flowing through conduit 120.

Alternatively, still referring to FIG. 6, the negative pressure conduit 102 having been attached to canister 70 at the opening 72 and providing a negative pressure to upstream end 104, is supplemented by directed pressurized fluid through conduit 82 inserted into canister 70 through opening 78. For filters 20 proving to be difficult to clean, the ability to direct pressurized fluid as to a discrete area of the "normal operation" downstream end 106 of filter 20 while locating negative pressure conduit 102 in the same discrete area on upstream end 104 is quite effective.

Alternatively, still referring to FIG. 6, the positive pressure may be pulsated to provide additional momentary air velocity and volume. This pulsated flow can be directed to a discrete area of the "normal operation" downstream end 106 of filter 20, or alternatively by connecting the pulsating air pressure source directly to opening 78. A plug added to the exhaust pipe behind the filter maybe used to prevent loss of flow out the vehicle exhaust pipe. In this case the negative pressure conduit 102 would still be attached to canister 70 at the opening 72 providing a negative pressure to upstream end 104, to remove the contaminate.

Figure 13:
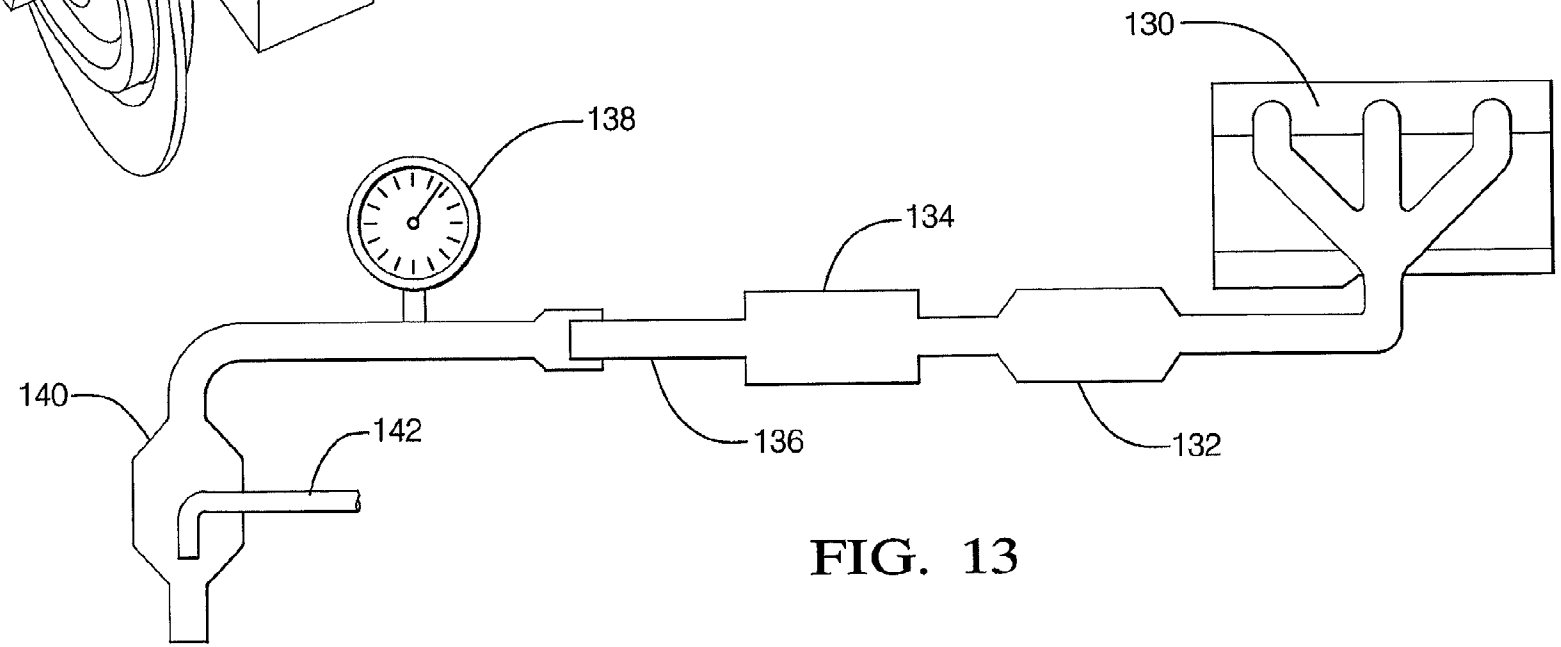
FIG. 13 is a schematic view of a vacuum value check system.

The method discussed herein is benefited by a knowledge of when the filter 20 which is in need of cleaning, and has been sufficiently cleaned. This can be accomplished by the manufacturer of the target system by providing a "known clean" negative pressure numerical value at opening 72. This value is employable to determine how "plugged" the filter 20 is by connecting a vacuum gauge to the downstream end of the system and removing plug 74 from opening 72. A numerical value of vacuum is then obtainable based upon a fixed negative pressure. If the vacuum numerical value is larger than "known clean" then particulate matter has impeded flow through filter 20. A threshold value would also be provided by the manufacture of the system for a cleaning action as described above. The manufacture would also provide a means of calibrating such a system so that it would be useable with the varying amount of flow induced by various vacuum sources. Likewise, after a cleaning operation, the vacuum gauge may again be connected to test the effect the cleaning operation has had. It should be understood that in at least some of the foregoing embodiments, plug 76 would need to be reinstalled prior to testing. This testing operation, whether before or after cleaning, is schematically illustrated in FIG. 13 where the combustion source is 130, filter unit is 132, muffler unit is 134 and tailpipe end is 136. Attached to the schematically illustrated system is a vacuum gauge 138 and venturi vacuum device 140 with shop air supply 142.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method for reducing diesel contaminant and additive particulate matter in an internal combustion engine particulate filter comprising:

accessing said filter in an installed condition;

entraining said contaminant and additive particulate matter in an active, pulsating positive pressure fluid stream flowing in a direction opposite a fluid flow direction through said filter during normal operation of said filter while in the installed condition; and applying a negative pressure to said filter.

2. A method for reducing diesel contaminant and additive particulate matter in an internal combustion engine particulate filter as claimed in claim 1 wherein said negative pressure is applied to an end of said filter associated with fluid entrance during normal operation of said filter.

3. A method for reducing diesel contaminant and additive particulate matter in an internal combustion engine particulate filter as claimed in claim 1 wherein said stream is a gas.

4. A method for reducing diesel contaminant and additive particulate matter in an internal combustion engine particulate filter as claimed in claim 1 wherein said stream is a liquid.

5. A method for reducing diesel contaminant and additive particulate matter in an internal combustion engine particulate filter as claimed in claim 1 wherein said stream is air.

6. A method for reducing diesel contaminant and additive particulate matter in an internal combustion engine particulate filter as claimed in claim 1 wherein said stream is water.

* * * * *